United States Patent [19]

Andeen et al.

[11] Patent Number: 5,032,850

[45] Date of Patent: Jul. 16, 1991

[54] METHOD AND APPARATUS FOR VAPOR JET PRINTING

[75] Inventors: Gerry B. Andeen, Pandan Valley, Singapore; Ronald Swidler, Palo Alto, Calif.; Hisashi Nishikawa, Shizuoka, Japan; Yasuo Matsumoto, Shizuoka, Japan; Ayumu Makino, Shizuoka, Japan

[73] Assignee: Tokyo Electric Co., Ltd., Tokyo, Japan

[21] Appl. No.: 452,686

[22] Filed: Dec. 18, 1989

[51] Int. Cl.[5] ..... B41J 2/015; B41J 2/21

[52] U.S. Cl. ..... 346/1.1; 346/75

[58] Field of Search ..... 346/1.1, 140

[56] References Cited

U.S. PATENT DOCUMENTS

| | | | |
|---|---|---|---|
| 1,627,701 | 5/1927 | Hall | 358/296 |
| 1,656,338 | 1/1928 | Ranger . | |
| 1,709,926 | 4/1929 | Weaver | 358/75 |
| 1,841,452 | 1/1932 | Ranger . | |
| 2,951,894 | 9/1960 | Hirsch | 346/140 X |
| 3,373,438 | 3/1968 | Hochberg . | |
| 3,632,291 | 1/1972 | Defago . . | |
| 3,709,432 | 1/1973 | Robertson . | |
| 3,739,084 | 6/1973 | Heinrich | 358/283 |
| 3,763,308 | 10/1973 | Miyata et al. | 178/5.2 R |
| 3,854,399 | 12/1974 | Keur et al. . | |
| 3,950,967 | 4/1976 | Davies et al. | 68/5 D |
| 4,019,188 | 4/1977 | Hochberg et al. . | |
| 4,141,231 | 2/1979 | Kudlich | 68/205 R |
| 4,203,554 | 5/1980 | Zimmer et al. | 239/585 |
| 4,369,450 | 1/1983 | Iwagami et al. . | |
| 4,415,910 | 11/1983 | Reece | 346/140 R |
| 4,503,444 | 5/1985 | Tacklind . | |
| 4,628,331 | 12/1986 | Ishikawa . | |
| 4,647,945 | 3/1987 | Andeen | 346/1.1 |

FOREIGN PATENT DOCUMENTS

| | | |
|---|---|---|
| 0124116 | 11/1984 | European Pat. Off. . |
| 50-11291 | 9/1975 | Japan . |
| 52-13861 | 11/1977 | Japan . |
| 52-138615 | 11/1977 | Japan . |
| 55-76149 | 6/1980 | Japan . |
| 57-132476 | 7/1982 | Japan . |
| 58-8189 | 1/1983 | Japan . |
| 1482596 | 7/1974 | United Kingdom . |
| 2122951 | 4/1983 | United Kingdom . |

OTHER PUBLICATIONS

M. L. Levine et al., "Material Transfer Recording", *Applied Optics*, vol. 9, No. 10, Oct. 1970, pp. 2260–2265.

C. A. Bruce and J. T. Jacobs, "Laser Transfer of Volatile Dyes", *J. Appl. Photographic Engineering*, vol. 3, No. 1, Winter 1977, pp. 40–43.

R. S. Braudy, "Laser Writing", *Proc. IEEE*, Oct. 1969, pp. 1771–1772.

Robert S. Braudy, "Characteristics of Organic Colorants Transferred by Laser Scanning", *J. Appl. Physics*, vol. 45, No. 8, Aug. 1974, pp. 3512–3515.

*Primary Examiner*—Joseph W. Hartary

*Attorney, Agent, or Firm*—Flehr, Hohbach, Test, Albritton & Herbert

[57] ABSTRACT

A method of vapor jet printing is described, along with several embodiments of apparatus for practicing such method. The vapor phase of a sublimable dye is mixed with a carrier gas. The resulting mixture is then jetted toward a recording medium. The carrier gas in indirectly heated by the sublimable dye to maintain the latter in its vaporous state during its travel to the recording medium. One embodiment of the apparatus includes a removable cartridge for the sublimable dye which enables color interchangeability and a limited downtime for dye recharging.

9 Claims, 3 Drawing Sheets

Fig. 1
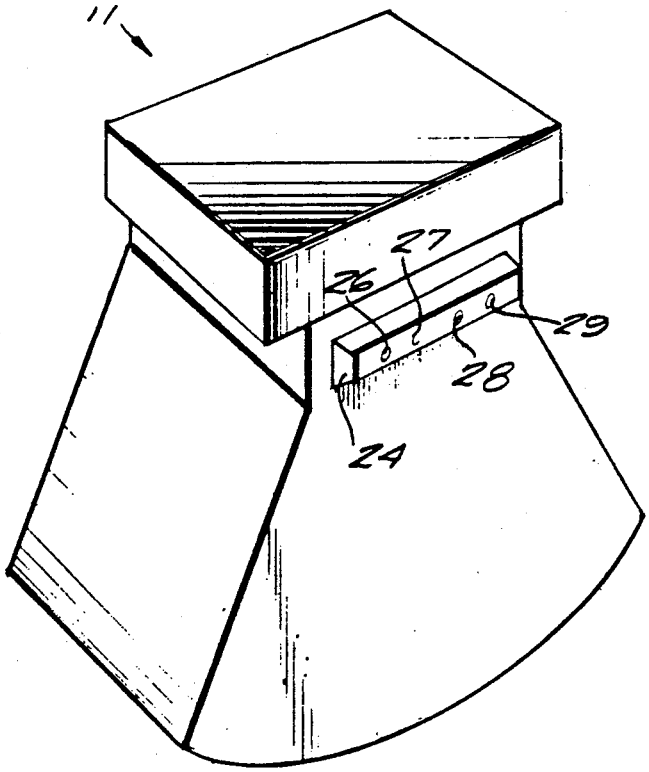
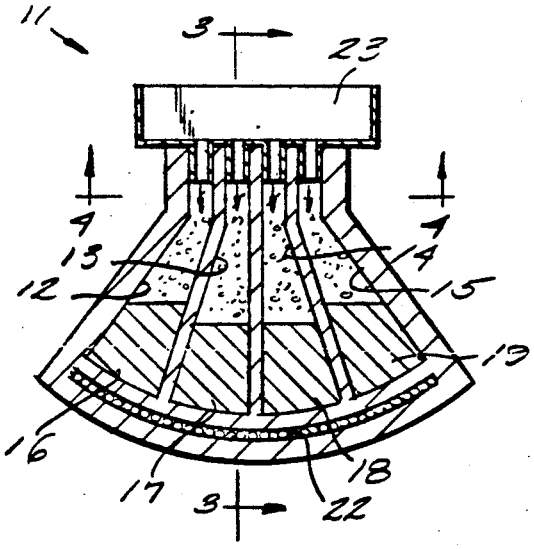
Fig. 2
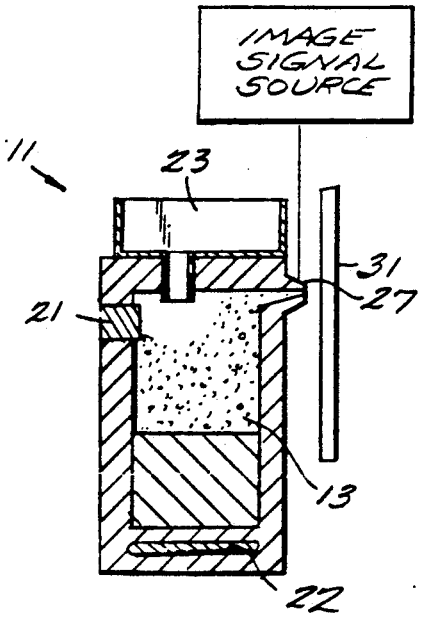
Fig. 3

Fig. 4
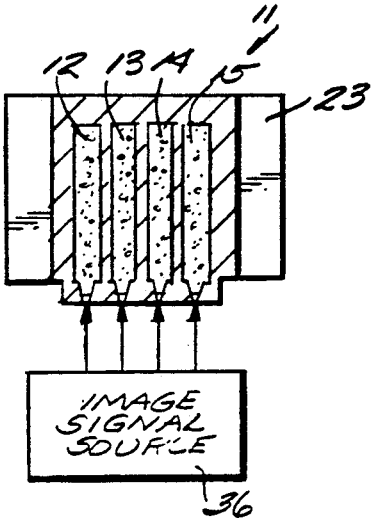
Fig. 5
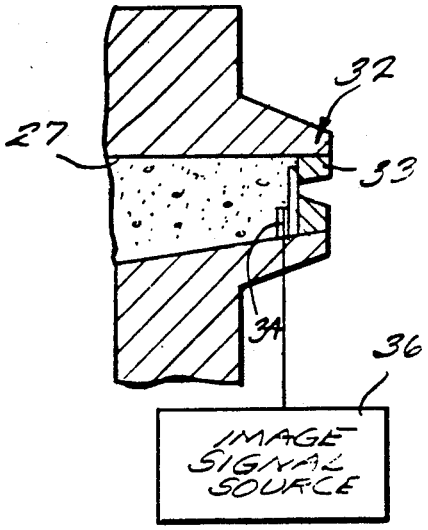
Fig. 6
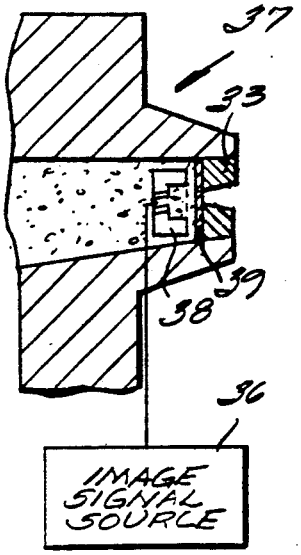
Fig. 8
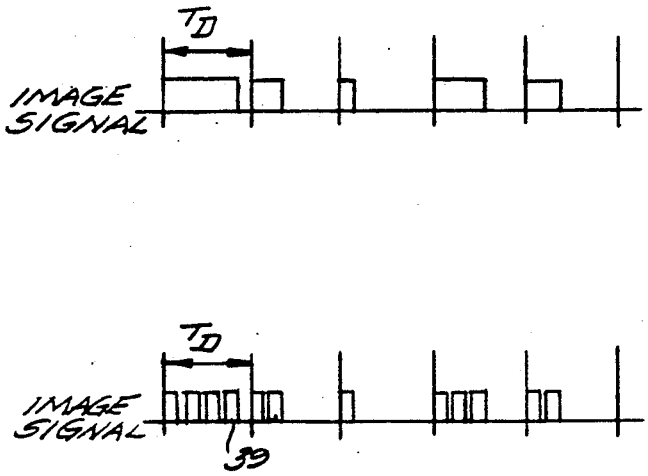
Fig. 7

METHOD AND APPARATUS FOR VAPOR JET PRINTING

BACKGROUND OF THE INVENTION

The present invention relates to the production of images or representations, such as in high-speed printing. More particularly, it relates to a method and apparatus for effectively applying a coloring agent to a recording medium.

Most printing of alphanumeric characters is accomplished by impact printing. That is, in general, a mechanical member of one sort or another which defines all or part of each of the characters to be imprinted, is used to impact an ink or coloring agent medium. However, because of a desire of high-speed printing , less noise, etc., much effort has been expended toward non-impact printing. Some of this effort has been devoted to attempting to provide a commercially successful vapor jet printing mechanism. Such a mechanic is one in which a vaporous coloring agent is transferred via a jetting action to a recording medium.

The approach used most often in vapor jet printing, has been to attempt to print dots which can be arranged to define desired alphanumeric characters. For such a method to provide quality printing with the high resolution necessary, the dots which are provided on the recording medium must be quite small. Moreover, the location of such dots on the recording medium must be accurately controllable.

It will be appreciated that the manner of transferring the coloring agent to the recording medium is an important part of vapor jet printing, particularly in connection with assuring small dot size and accurate control over printing location. Many vapor jet printing arrangements considered in the past have utilized electrical deflection means to provide the transfer. In these schemes the coloring agent is charged and then deflected to a desired location. Such schemes have various disadvantages, a primary one being decomposition of the coloring agent if it is, as in most situations, the vapor state of a sublimable dye. Moreover, most of such arrangements require relatively large spacing between the jet from which the coloring agent emanates and the recording medium, to accommodate the deflection and charging mechanism. The coloring agent, if it is heated such as is typical for a sublimable dye, can be cooled by the atmosphere in such space and solidified before it reaches the recording medium. This, of course, results in a degraded image. Also, most applications for vapor jet printing require multiple jets of one or more coloring agents. The necessity with this approach of controlling the individual jets of coloring agent results in added complexity. Examples of this approach are disclosed in Japanese Patent Publication Nos. 56-2020; 54-71636; and 54-71637.

Other arrangements which have been considered rely simply on the vapor pressure of the coloring agent itself to provide a jetting action, i.e., there is no means for forcibly jetting the vaporous coloring agent. Such a method is described, for example, in Japanese Patent Publication No. 57-1771. One problem with this approach is that in periodic passes of a coloring agent through a jetting nozzle, the coloring agent of one pass may be left in the nozzle because of the low pressure or force used to eject the same. This earlier coloring agent is mixed with the subsequent coloring agent passed through the nozzle and thus changes the amount which is jetted. This deleteriously affects the parameters of printing. Moreover, when the coloring agent is a condensable vapor, it may condense in the nozzle and restrict the same. While heating of vapors has been employed to raise the vapor pressure of the coloring agent, such heating has not solved the nozzle problems.

It also has been proposed to use a gas such as air as a carrier to transport vaporous dyes to the recording medium. Japanese Patent Publication No. 59-22759 is an example of such an arrangement. U.S. Pat. No. 3,950,967 discloses such an arrangement designed for coloring a textile material. Mechanisms which have relied upon this procedure have been less than ideal. One major problem is that it is difficult to control the amount of coloring agent which is transferred during any selected period, i.e., the amount of coloring agent within the gas carrier stream varies. This lack of control, interferes of course, with color proportioning, obtaining desired color densities, etc. Moreover, the use of the gaseous stream of this nature can result in solidification of vaporous coloring agents, such as sublimable dyes in their vapor state. It also should be mentioned that the system of Japanese Patent Publication No. 59-22759 utilizes a relatively expensive laser optical system to form a vaporous coloring agent from solid, sublimable dye rods. It is difficult to incorporate such a system into a multi-head arrangement because of the relatively complex optical and delivery systems utilized in such arrangement, and also to control the gating "on and off" of the formation of the desired vaporous dyes.

SUMMARY OF THE INVENTION

The present invention is a method and apparatus for applying a coloring agent to a recording medium which does not have the disadvantages of prior art approaches discussed above. While a carrier gas, such as air, is used to transport the coloring agent to the recording medium, in accordance with the invention it is mixed with the coloring agent while the latter is in its vaporous state before being ejected toward the recording medium. Most desirably, the coloring agent and gas are intimately mixed together to form a generally uniform mixture prior to being ejected. It will be recognized that this will assure that a selected known amount of coloring agent will be ejected toward the recording medium. Also most desirably, the mixture is pressurized to be ejected in a controlled manner at a pressure of from about 0.1 to about 2.0 p.s.i. toward the recording medium. This pressurization simply is achieved by providing the carrier gas itself under a desired pressure when it is maixed with the coloring agent, and it has been found that recording at speeds of from 5 to 20 cm/sec can advantageously can be used.

The carrier gas is heated to maintain the coloring agent in a vaporous phase during use of such gas to transport the coloring agent to the recording medium. This is most easily accomplished by passing the gas mixture through a channel the temperature of which is maintained at an appropriate level. Most simply and desirably, the coloring agent is a sublimable dye in solid form which is heated to form a vaporous dye which is then mixed with the carrier gas to form the desired, heated mixture. To achieve this end it is preferred to use chamber temperatures of from about 400 degrees F to about 500 degrees F and nozzle diameters of from about 20 micrometers to about 125 micrometer.

As another salient feature of the instant invention, the coloring agent is provided in a stand-alone cartridge which can be interchangeably connected with the remainder of the apparatus, including the ejection nozzle, to complete the arrangement. It will be recognized that the provision of such a cartridge simplifies the operation of providing new coloring agent or changing colors, and significantly reduces the down-time associated therewith.

As will be appreciated from the more detailed description of a preferred embodiment, the simplicity of the method and apparatus of the invention lends itself well to multi-head arrangements, i.e., arrangements having a plurality of sources of coloring agents and a plurality of nozzles. Moreover, it is particularly applicable to use of sublimable dyes as the coloring agents.

BRIEF DESCRIPTION OF THE DRAWINGS

With reference to the accompanying three sheets of drawing:

FIG. 1. is a perspective view of a schematic representation of a first embodiment of the instant invention;

FIG. 2 is a sectional view of the embodiment of FIG. 1;

FIG. 3 is a second sectional view of such embodiment taken on a plane indicated by the lines 3—3 in FIG. 2 and including a representation of a recording medium and an image signal source;

FIG. 4 is another sectional view of the embodiment of FIG. 1, taken on a plane indicated by the lines 4—4 in FIG. 2;

FIGS. 5 and 6 are enlarged sectional and broken-away views of gating mechanisms for the nozzles of the embodiment of FIG. 1;

FIGS. 7 and 8 are schematic graphic representations of image signals;

DETAILED DESCRIPTION OF THE PREFERRED EMBODIMENT

Figure 9:
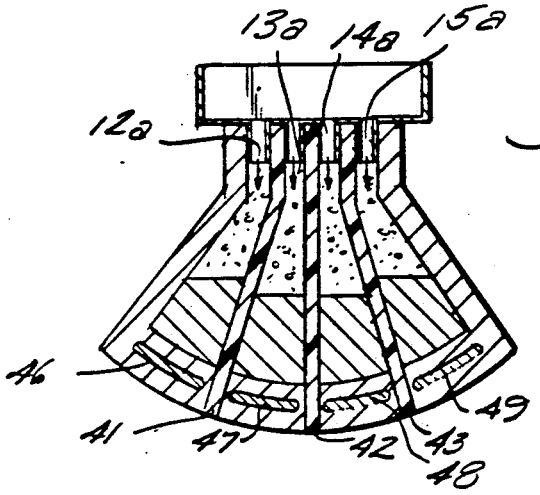
FIG. 9 is a view similar to he view of FIG. 2, showing an alternate embodiment.

The first preferred embodiment of the apparatus of the invention is illustrated in FIGS. 1–5. A recording head for applying four differing coloring agents to a recording medium is generally referred to by the reference numeral 11. As is best illustrated in FIGS. 1 and 2, such recording head 11 includes four chambers 12–15 individually containing sublimable dyes in solid form to produce desired vaporous coloring agents. While in the drawing the sublimable dyes in solid form are schematically illustrated in the chambers 12–15 as blocks 16–19, respectively, it is preferred that they be provided as is typical in powder form. The dyes could be of any desired color which is available. The sublimable dye 16 could be, for example, a cyan dye, the sublimable dye 17 could be a magenta dye, the sublimable dye 18 could be a yellow dye, and the dye 19 could be a black dye. A blocked entrance for supplying dye in powder form is provided for each of the chambers, and is schematically represented at 21 in FIG. 3 for chamber 13.

A source of heat in the form of a heater 22 is included within the base wall of the recording head 11 to provide simultaneous heating of the sublimable dyes in the four chambers 12–15. Such heater is preferably an electrical resistance heater electrically insulated from the recording head material.

The amount of heat energy applied to the dyes, and hence, the temperature to which the heater is raised will depend upon the particular sublimable dyes which are used, as well as the desired vapor pressures. Temperature is an important factor, since if the temperature is too high the dye will degrade. On the other hand, if the temperature is too low, the density of recording of the medium declines. While a combination of variables affects print quality, it was determined that chamber temperatures of from about 400 degrees F to about 500 degrees F produced the desired print.

As is indicated by the dots in the figure, the dyes will sublime and form a vaporous state in the upper portion of the respective chambers 12–15. Means are provided for furnishing a carrier gas to the upper portion of such chambers for mixture with the dyes. A reservoir 23 is schematically illustrated for this purpose, containing a pressurized gas, such as air. Such reservoir is individually communicated with each of the chambers 12–15, as is represented in FIG. 2. The result is that a gas under pressure (in this case air) is mixed with the sublimable dyes in the individual chambers. The carrier gas is heated to a temperature which will maintain the dye with which it is mixed in a vaporous state. Most simply, the dye itself is provided with sufficient thermal energy to heat the carrier gas with which it is mixed before being ejected as described below. The structure communicating the reservoir with the chambers is, in essence, means connecting the sources of coloring agents with the source of carrier gas.

The recording head 11 includes a nozzle structure 24 on its front face, having individual nozzles 26–29 communicating respectively with the dye chambers 12–15. Such nozzles face a recording medium 31 (FIG. 3) at a relatively close spacing. The diameter of the nozzles 26–29 must be large enough to permit flow such that the speed of the printer is not limited thereby. This must be balanced, however, against the need to keep the diameter of, for example, dots printed, to an appropriate size.

It was found that nozzle diameters of from 20 to 125 micrometers were useful. Tests were conducted at 20, 75 and 125 micrometers. Line widths created were as small as 1.5 times the nozzle diameter. During such tests it was found that spreading of the printed line beyond the size of the nozzle was due to turning of the stream as it approached the print surface, and that the jet itself did not spread significantly over the distances involved. That is, it was found that distance from the print surface was not critical. In addition, it was also found that the halo, i.e., background coloring over a larger area in the vicinity of the nozzle, can be eliminated by applying an air flow across the printing surface at the jet. The cross-jet-flow air flow eliminates the halo, thus providing a sharper print.

As is conventional, the recording medium can be, for example, a sheet of paper or plastic upon which it is desired to impart graphical representations.

Because the coloring agent–carrier gas mixture is under pressure, it is important that the individual nozzles 26–29 be gated. In the dye chambers pressures of from about 0.1 p.s.i. to about 2.0 p.s.i. are advantageously used. If the chamber pressure is too high, dye will be ejected from the nozzle at excessive speed, causing the dye to spread before adhering to the recording medium. If the chamber pressure is too low, the ejected dye may cool before reaching the medium and will therefore not properly adhere.

FIG. 5 illustrates an embodiment of a gate or shutter arrangement which can be used to provide gating. With reference to such figure, a gate 32 is shown in the outlet port of the illustrated nozzle. Such gate includes not only an annulus 33 restricting the size of the nozzle orifice, but an electrostriction vibrator 34 for controlling opening and closing of the nozzle orifice. It should be noted that the carrier gas sublimable dye mixture will be at a relatively high temperature of between 400 and 500 degrees F. Thus it is important that the vibrator 34 be one which is capable of withstanding and operating under such high temperature conditions.

A voltage is applied to the electrostriction vibrator to open and close the same, the application of which voltage is controlled by an image signal source. Such source is schematically represented in the figures by block 36. Each of the nozzles includes a gate for controlling the flow of the mixture in its associated dye chamber therefrom. This is schematically represented in FIG. 4 by the illustration of flow lines extending from the source 36 to each of the nozzles.

FIG. 6 illustrates another type of nozzle gating device that may be used with the instant invention. It is similar to the gating device shown in FIG. 5 and like reference numerals are used for common parts. Such device, generally referred to by the reference numeral 37, includes an electromagnet 38 for vibrating a gate valve 39. Again, because the carrier gas sublimable dye mixture is at a relatively high temperature, it is desirable that the Curie temperature of the core portion of the electromagnet be above 300 degrees C.

It is believed that the method of the invention is readily apparent from the above description of the apparatus of the first embodiment. The coloring agents in the individual chambers (in this case, sublimable dyes in their vaporous state) are mixed with a carrier gas and thereafter the mixture is ejected toward the desired location on the recording medium The configuration of each of the chambers assures that there is an intimate mixture of the coloring agent and gas to form a generally uniform mixture prior to it being ejected. Moreover, the carrier gas is provided under pressure. This results in the mixture also being pressurized. The carrier gas is indirectly heated to assure that it will maintain the coloring agent in vaporous form between the time the individual mixtures are jetted from the nozzles and they strike the recording medium. In this particular arrangement in which the coloring agent is a sublimable dye, sufficient thermal energy is provided to each solid dye both to form and maintain its vaporous state and also to heat the carrier gas with which each is mixed. The carrier gas should be heated to a temperature at or above the temperature at which the sublimable dye will maintain its vaporous phase during travel to the recording medium. Ejection of the mixture toward the recording medium is controlled to occur only when it is desired, by the gating devices.

FIGS. 7 and 8 are timing charts which indicate how with vibration of the gates of one of the respective nozzle gating devices, the amount of mixture ejected from a nozzle can be controlled. Periodic time demarcations or intervals are represented in such figures by uniformly separated lines, the distance between any two of which is the same, as is represented by TD. The vibration rate provided by a gating device of a nozzle is represented in the figures by pulses 39. Each of these pulses represents an "open" state of a gate and the frequency and amplitude of all of such pulses are the same, with the result that each represents a predetermined amount of carrier gas-coloring agent mixture which is allowed to eject. (This is assuming, of course, that the pressure within each of the dye chambers remains relatively constant.) It thus will be seen that during any selected time interval TD, the number of pulses which are applied to a gating device will control the amount of mixture which actually is ejected during such time interval.

Various colors can be obtained on the recording medium by mixing the vaporous dyes. To this end, the directions of the nozzles may be set so that the carrier gas coloring agent mixture of a plural number of them will be converged to the same spot on the recording medium. Alternatively, the vaporous dye can be made to impinge at different locations on the recording medium. It will be appreciated that sequential passing of a recording head by the same spots on the recording medium can be used to mix different colors at a single spot to form a desired color.

The following parameters are suggested as guidelines for the design of specific equipment utilizing air as a carrier gas and sublimable dyes:

Temperature: 400 degrees F (204 degrees C)
Orifice: 20-micrometer diameter
Carrier gas pressure: 0.1 psi (700 Pa)
Printing speed: 1 cm/s
Full-width array: 250 lines (nozzles)/inch
Gating frequency: 2000 Hz In some situations, depending largely on the sublimable dyes which are selected, it is desirable to be able to control the thermal energy imparted to each separately, in spite of the fact that a plurality of chambers are provided. FIG. 9 illustrates a simple modification which can be made to the embodiment which is described above, to facilitate such separate heat control. The individual dye chambers 12A–15A are separated from one another by thermally insulating walls 41–43. The single heater 22 of the earlier embodiment is replaced by individual heaters 46–49 associated with the individual chambers and controllable separately. It thus will be seen that different amounts of thermal energy can be transmitted to the separate chambers.

Figure 10:
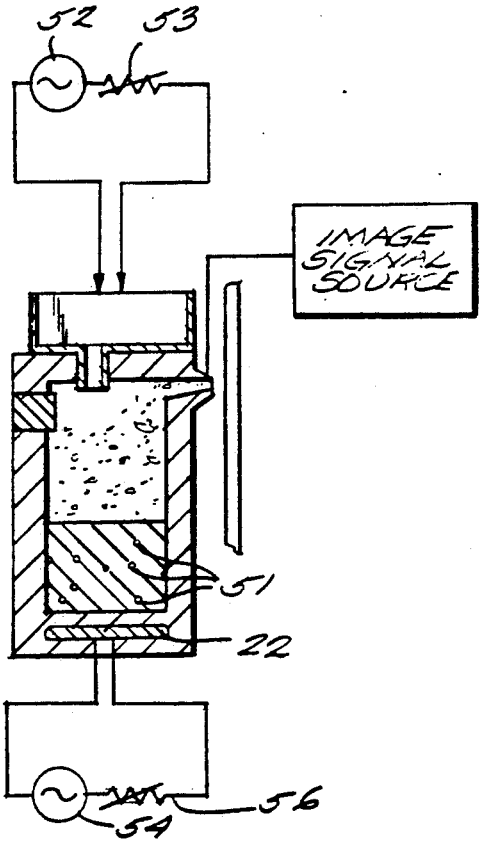
FIG. 10 is a sectional view similar to FIG. 3 of a third embodiment of the instant invention.

Sublimation of the dyes can be enhanced by including high thermal conductivity material in the chambers with the solid form of the same. As previously mentioned the sublimable dye is preferably provided in powder form, and FIG. 10 illustrates metal (steel) shot 51 combined with the same. It is important that the high thermal conductivity material mixed with the solid sublimable dye be stable or inert with respect to such dye at the temperatures and pressures of operation.

The embodiment illustrated in FIG. 10 also includes a schematic illustration of a power source 52 and an adjusting mechanism 53 for controlling the pressure of gas to be injected into the illustrated dye chamber. It will be appreciated that adjustment of such pressure will change the mixture pressure and, thus, the color density or proportion obtainable in the ultimate image. Such figure also illustrates a power source 54 and an adjustment mechanism 56 for the heater 22. This representation is included to bring out the fact that the mixture pressure and hence the density of the image also can be adjusted by changing the amount of thermal energy applied to the sublimable dye. A change in the thermal energy changes the pressure of the dye in the vaporous state, the ultimate mixture pressure, and hence, the density of the image.

Figure 11:
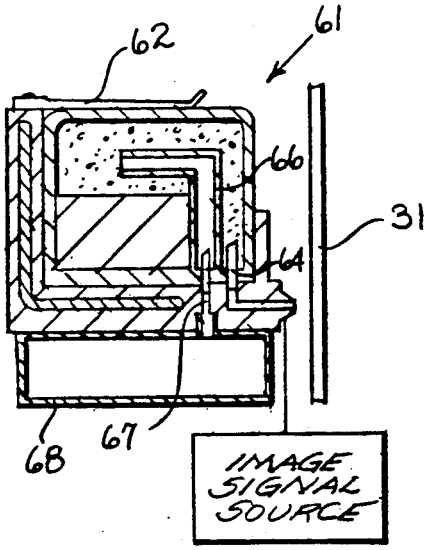
FIG. 11 is a sectional view of a schematic representation of a fourth embodiment of the invention.

It is desirable to be able to replenish or change the coloring agent associated with each nozzle in a rapid manner. The embodiment of the invention illustrated in FIG. 11 facilitates such an arrangement. The sublimable dye is provided within a stand-alone cartridge 61 which is removably securable to the remainder of the apparatus. That is, the remainder of the apparatus includes a leafspring 62 which resiliently urges the cartridge 61 into a pocket of the apparatus sized to fit the same. Such apparatus includes means for ejecting a carrier gas-vaporous coloring agent toward a recording medium. In this connection, the apparatus is provided with a tubular needle 64 that communicates with its nozzle and is designed to register with and penetrate through an appropriate seal in the cartridge to provide a passage to the nozzle for the gas mixture.

The cartridge itself includes a tubular connection 66 extending from a gas inlet through the volume of the cartridge that may contain the sublimable dye in solid form to that portion of the cartridge designed for the vaporous phase of the dye. The apparatus is provided with a second tube 67 which is designed to penetrate an appropriate seal into the cartridge for communication with the tubular connection 66. Means are thus provided for conveying gas under pressure from a source 68 in the remainder of the apparatus to the sublimable dye in the cartridge when the dye is in its vaporous state.

It will be seen that a plurality of stand alone cartridges can be provided designed to cooperate with the remainder of the apparatus to apply desired dye to a recording medium 31. Such cartridges can have differing coloring agents. In this connection it will be appreciated that because the gas mixture is under pressure and the passage through the apparatus to the output end of the nozzle is relatively short, there will be very little mixture of color when cartridges having differing coloring agents are used sequentially. The apparatus can include the nozzle, the cartridge, and means (the heater, gas source nozzle, passage way etc.) for conditioning the coloring agent for impingement at a desired location on the recording medium. This embodiment otherwise is similar to the earlier described embodiments and like reference numerals are used to refer to common parts.

While the invention has been described in connection with preferred embodiments, it will be appreciated by those skilled in the art that various changes can be made. For example, although the coloring agent is described in the preferred embodiment as being a sublimable dye, it will be recognized that other types of coloring agents may also be used appropriately with the invention. Such coloring agent may itself not provide a desired color. It may be an acid or other material which will react with the recording medium to provide a selected color. In view of the various modifications that can be made, it is intended that the scope of the invention only be defined by the claims and their equivalents.

We claim:

1. In a method of applying a coloring agent to a recording medium, the steps of:

mixing the coloring agent with a carrier gas in a chamber having a gated nozzle while the coloring agent is in a vaporous state and said carrier gas is under a pressure in the range of 0.1 to 2.0 psi, thereby to form a mixture thereof in said chamber;

positioning the gated nozzle of said chamber facing said recording medium;

thereafter ejecting said mixture toward a desired location on the recording medium at said pressure in the range of 0.1 to 2.0 psi by opening and closing the gate of said nozzle to divide the mixture into predetermined amounts;

varying the number of said predetermined amounts ejected toward said desired location at any given time proportionate to the amount of said mixture desired at said location at such time; and oscillating said gate between an open and closed state by applying a high frequency control signal of sufficiently high frequency that said mixture is maintained at an ejecting pressure within said range.

2. A method as recited in claim 1, wherein said coloring agent is a sublimable dye and said chamber has a temperature of from about 400° F. to about 500° F.

3. A method as recited in claim 1, wherein said step of oscillating said gate further includes the step of oscillating said control signal at a frequency of approximately 2,000 Hz.

4. In an apparatus for applying a color agent to a recording medium, the combination of:

a source of a coloring agent in a vaporous state;

a source of a carrier as under pressure in the range of 0.1 to 2.0 psi;

a chamber;

means connecting said sources together to mix in said chamber the carrier gas with the coloring agent while the latter is in a vaporous sate and thereby form a pressurized mixture thereof;

a nozzle for ejecting the pressurized mixture of said carrier gas and coloring agent toward a desired location on the recording medium at said pressure in the range of 0.1 to 2.0 psi;

a gate at said nozzle for opening and closing said nozzle to control flow of said pressurized mixture from said nozzle, the opening and closing of said gate thereby dividing the mixture into predetermined amounts; and an image signal source for controlling the opening and closing of said gate; said image signal source providing a high frequency pulsating signal for oscillating said gate between an open and closed state at a sufficiently high frequency to maintain said mixture at a stable ejection pressure in said range; and said pulses having the same frequency and amplitude in a predetermined time interval, whereby a selected amount of said mixture of said carrier gas and coloring agent is ejected form said nozzle toward said recording medium.

5. An apparatus as recited in claim 4, wherein said source of coloring agent in a vaporous state includes a container for a sublimable dye in solid form, heating means for transforming a portion of said sublimable dye to its vaporous state, a power source for said heating means, and an adjusting means for varying the thermal energy output of said heating means.

6. An apparatus as recited in claim 4, wherein said source of said coloring agent is one of a plurality of stand-alone cartridges for containing a selected coloring agent when said cartridge is separated from the remainder of said apparatus, which cartridge is securable to said apparatus to cooperate with said source of carrier gas, said connecting means and said nozzle by supplying coloring agent to be applied to a recording medium.

7. An apparatus as recited in claim 4, wherein said high frequency pulsating signal has a frequency of approximately 2,000 Hz.

8. In an apparatus for applying a coloring agent to a recording medium, the combination of:

a source of a carrier gas under pressure in the range of 0.1 to 2.0 psi;

a nozzle having an inlet for receiving a coloring agent and an outlet for ejecting a coloring agent toward a recording medium;

a plurality of individually securable stand-along cartridge means for holding selected coloring agents separate from the remainder of said apparatus, such tat the coloring agent in one of said cartridge means is different from the coloring agent in at least one other of said cartridge means and each individually securable cartridge means further comprising:

a containment portion for holding a sublimable coloring agent in a vaporous state in a first region thereof and in a solid state in an adjacent region thereof;

tubular means for conveying said gas while it is under said pressure in the range of 0.1 to 2.0 psi to said first region of said containment portion whereby said vaporous coloring agent and carrier gas are mixed to form a pressurized mixture, and said tubular means has an inlet for sealable engaging said source of gas under pressure and an outlet disposed in said first region of said containment portion; and passage means having a first end disposed in said first region of said containment portion apart from said tubular means and having an ejection bend for matingly engaging said inlet of said nozzle whereby said pressurized mixture of gas and coloring agent is ejected into said nozzle and to said recording medium.

9. An apparatus as recited in claim 8, wherein said apparatus for applying a coloring agent further has a heater means provided in a surface thereof disposed for adjacent contact with said containment portion of said individually securable cartridge means to heat said dye to a temperature of from about 400° F. to about 500° F. to cause said sublimable coloring agent to pass to a vaporous state.

* * * * *